US006288637B1

(12) United States Patent
Thomas et al.

(10) Patent No.: US 6,288,637 B1
(45) Date of Patent: Sep. 11, 2001

(54) FIRE PROTECTION SYSTEM

(76) Inventors: Charles L. Thomas, 2100 Queens Rd. E., Charlotte, NC (US) 28207; Jerry Deane Crane, 203 Cedar St., Anderson, SC (US) 29626

( * ) Notice: Subject to any disclaimer, the term of this patent is extended or adjusted under 35 U.S.C. 154(b) by 0 days.

(21) Appl. No.: 09/499,078

(22) Filed: Feb. 4, 2000

Related U.S. Application Data

(60) Provisional application No. 60/119,398, filed on Feb. 10, 1999.

(51) Int. Cl.[7] ..... G08B 29/00

(52) U.S. Cl. ..... 340/506; 340/505; 340/514; 340/533; 340/825.06; 340/825.07; 340/825.08; 340/10.1

(58) Field of Search ..... 340/506, 505, 340/507, 514, 516, 533, 825.06, 825.07, 825.08, 10.1

(56) References Cited

U.S. PATENT DOCUMENTS 5,400,246 * 3/1995 Wilson et al. ..... 340/825.06 X

* cited by examiner

*Primary Examiner*—Daryl Pope
(74) *Attorney, Agent, or Firm*—Adams, Schwartz & Evans, P.A.

(57) ABSTRACT

A fire protection system for determining the existence of hazardous conditions within a building. The system includes a central monitor node for monitoring and displaying system status information. At least one zone node is located remote from the monitor node, and defines a plurality of fire protection zones within the building. A plurality of detectors are arranged within each zone at respective predetermined address locations. Each of the detectors includes a micro-controller for detecting and storing information indicating an occurrence of a hazardous event. The detectors have a normal negative state wherein no occurrence of a hazardous event is detected, and a positive state wherein the occurrence of a hazardous event is detected. The zone node includes detector interrogation circuitry for interrogating the plurality of detectors to determine their respective positive or negative states, and for determining the address location for each of the plurality of detectors in a positive state indicating the occurrence of a hazardous event. A communication line electronically interconnects the zone node and the monitor node for relaying information from the zone node to the monitor node indicating the address location for each of the plurality of detectors in a positive state. The address location of all detectors in a positive state is displayed to a system user at the monitor node.

1 Claim, 8 Drawing Sheets

ALARM LOG
Zone 01 of 03
Zone_Name 22 (22)
03 Alarms

Fig. 3A

ALARM LOG
Zone 02 of 03
Zone_Name 34 (34)
02 Alarms

Fig. 3B

ALARM LOG 01/02
Zone_Name 34 (34)
Zone Fire Detected
01/01/99 18:38

Fig. 3C

ALARM LOG 02/02
Zone_Name 34 (34)
Fire Detected D059
01/01/99 18:38

Fig. 3D

TROUBLE LOG
Zone 01 of 02
Zone_Name 22 (22)
01 Troubles

Fig. 4A

TROUBLE LOG 01/01
Zone_Name 22 (22)
Ext Disconnected
01/01/99 18:38

Fig. 4B

SYSTEM LOG 350/350
Zone_Name 22 (22)
Ext Disconnected
010199 18:38 TROUBLE

Fig. 5

SELF TEST INFO
Test Results
Manual 010100 17:30
Passed # Zones: 02

Fig. 6A

SELF TEST INFO
Test Results
Manual 010100 17:30
Failed # Zones: 01

Fig. 6B

ST FAIL - (22) 104,
108

Fig. 6C

ST FAIL - (55)
Not Enough Detectors

Fig. 6D

ST FAIL - (55)
Too Many Detectors

Fig. 6E

ST FAIL - (55)
More Than 16 Det

Fig. 6F

ST FAIL - (55)
Det Annun Line Fault

Fig. 6G

SYSTEM CONFIG
Def / Inst Zones: 02/02
Total Detectors: 020
AutoST: -M-W-F 01:45

Fig. 7A

SYSTEM CONFIG
Zone_Name 22 (22)
# of Detectors: 03
Shutdown Relay #: 08

Fig. 7B

SYSCFG OK - (22) 123
100, 101, 102, 103, 104
105, 106, 107, 108, 109,
109, 110, 111, 112, 113

Fig. 7C

SYSCFG TBL - (22) 100
101, 102, 103, 104

Fig. 7D

SELF TEST INFO
Test Results
Manual 010199 17:40
Passed # Zones: 01

Fig. 8A

SELF TEST INFO
Test Results
Manual 010199 17:40
Failed # Zones: 01

Fig. 8B

FIRE PROTECTION SYSTEM

This patent application corresponds to United States Provisional Patent Application No. 60/119,398 filed on Feb. 10, 1999.

TECHNICAL FIELD AND BACKGROUND OF INVENTION

This invention relates to a fire protection system, and more particularly to a fire protection system which includes an automatic self-test circuit. The circuit has particular utility with fire control systems of the type used in, for example, textile mills or other industrial environments where flammable materials such as textile fibers are entrained in a moving air stream and thus conveyed at high speed through enclosed duct work. Typically, the fibers are moved between processing stations. Infrared detectors are positioned in the duct work at intervals and are designed to detect the presence of embers or hot metal fragments in the moving air stream which could cause a fire or explosion. An infrared detector detecting a source of infrared energy in the moving air stream sends a signal to a control panel, where signals are transmitted to instantly shut off the fiber processing equipment. Signals may also operate diverters, fire extinguishers or other equipment intended to protect life and property from a fire or explosion.

Fire control systems are required to be inspected periodically to ensure that the system and its components are working properly. This periodic inspection is time consuming and labor intensive, therefore leading to the possibility that the inspection is not performed as diligently as it should be, or is not performed at all.

By automating this process, and causing it to be initiated automatically at a predetermined time each day, each week, or each month, a complete inspection can be performed to test each detector, and any detector failing the test will cause the system to show a trouble indication. The failed detector must be corrected before the system will clear the trouble indication. A record of each test is kept by the system for use of the authority having jurisdiction.

The major function which must be performed in order to fully implement the self-test feature is the ability to accurately ascertain which of the infrared detectors has been activated so that those which fail to activate may be reported. There have been a number of systems implemented that use serial communications as a means to provide detector address information. These have ranged from using a shared packet bus, as in the commercially available "Mastermind" panel, to the use of more powerful packet systems such as the commercially available "LonWorks" protocol. Each of these has carried a high cost of the interface and required additional wiring to the detector to carry this address information.

This application discloses a system wherein the address information is shared with the standard annunciator information brought back from the detector. This reduces the cost to implement and eliminates the need for either additional and/or more costly wiring to the detectors. Thus, the annunciator capability of the individual detectors transfers the information to the individual zone control of the control panel, identifying exactly which detector has sensed a fire, or in the case of testing, which detectors, if any, failed the detector test.

This application disclosed two implementations of the invention. Both implementations use a low cost microcontroller to act as the interface of the detector to the media both at the detector as well as the zone card. At the detector end, the microcontroller supervises the annunciator output from the detector which goes from a 0V state to a 24VDC state whenever a fire is detected. The microcontroller is attached to the media formerly used to carry the annunciator signal back to the zone card. It is attached so that one output may drive the media and one input monitors the state of the media. These I/O pins are attached such that the annunciator line becomes a shared bus for all of the detectors in the zone. The coupling is such that any detector may drive the bus high at any time except when the zone controller is driving the bus low.

In the first implementation, the detector interface accepts the annunciator input for the detector and drives the bus from a quiescent state of low (0V) to a high state (+5V). This change of state is detected by the microcontroller located on the zone card. Once the zone card has posted the event, the zone card drives the bus low to indicate to the detectors that have detected a fire they should send back their addresses. When the bus is pulled low by the zone card, all detectors that have detected a fire change their bus drives from a high to a low. After a short period of time, for example, 10 ms, the zone card drives the bus high briefly to indicate the state of a query frame. The query frame is a set timeslot, each having a period of 4 ms.

Each detector in the zone has a unique address ranging from 1 to 128. During the query frame, each detector will drive the bus high during the timeslot that is mapped to the detector's physical address. For example, if detector 5 has detected a fire, then it will pulse its output high during the 5th, 4 ms timeslot. Both the zone controller and the individual detectors keep track of the timeslots by internal timers in each controller that counts the timeslot in use after the start of query frame transition. The zone controller senses these high states from the detectors and logs those timeslots that have the bus high as having a detector with a fire indication. The total query time is 128×4 ms, or about 0.5 seconds.

This process is ideal where the microcontroller's oscillators are driven by some accurate method such as with a crystal. This accuracy is required since all processors are counting from the same start of frame edge and for 128 addresses the combined error of any two oscillators would have to be less than $1/128$, or the timeslots may be corrupted.

The second implementation further reduces the expense and complexity of the system by using internal RC oscillators that are present in very low cost microcontrollers. Thus, the need for accurate measurement as described above is eliminated. This is achieved by eliminating the need for a processor to count from the single start of frame. Instead, the zone controller synchronously clocks the timeslots onto the bus. The zone controller is therefore modified to create the start of frame as before. However, rather than simply driving a single start of frame pulse, the zone controller now drives the bus 128 times at a 4 ms interval with each high transition lasting 2 ms. Each of the positive transitions now indicates a timeslot and then during the low state condition, any detector with a fire indicated will pulse the bus high to indicate that there is a fire. This implementation allows each processor to reset its timer and re-synchronize with the zone, thus allowing for very low accuracy clocks to be used.

The second implementation is the preferred embodiment of the invention, as 20 described below.

SUMMARY OF THE INVENTION

Therefore, it is an object of the invention to provide a fire protection system which includes an automatic self-test circuit.

It is another object of the invention to provide a fire protection system which employs a method of signaling and data transmission between a zone controller and a number of fire detectors operating on a single pair of conductors; the method utilizing digital time division multiplexing to provide both addressing and data interchange.

It is another object of the invention to provide a fire protection system which includes user interface switches located on a control panel for convenient access and use.

It is another object of the invention to provide a fire protection system which includes password protected system programming.

It is another object of the invention to provide a fire protection system which includes a self test circuit such that any detectors failing the self test put the system in trouble.

It is another object of the invention to provide a fire protection system which provides a record of system testing for the authority having jurisdiction.

It is another object of the invention to provide a fire protection system which includes a self test circuit wherein the failing detectors remain in trouble until corrective action is taken.

It is another object of the invention to provide a fire protection system which includes a self test circuit wherein if all detectors function properly, the display and log will note "Self test performed (time) & (date) all detectors passed."

It is another object of the invention to provide a fire protection system which includes one or more zone nodes installed remotely from a monitor node, and preferably located at or near the machines being protected by those zones.

Preferably, the detectors are fitted with a chip that allows one wire to provide all the self test information to the zone, so only one wire is brought back from the detectors to the zone on new installations.

Preferably, the zone nodes are housed in enclosures that allow surface mounting.

It is another object of the invention to provide a fire protection system which includes battery backup circuitry incorporated in the monitor node.

It is another object of the invention to provide a fire protection system which meets NIFPA requirements for a 24 hour batery back up; the batteries being sufficient to maintain the system in a quiescent mode for 24 hours, and then put one zone in alarm for 5 minutes.

It is another object of the invention to provide a fire protection system which includes a set of contact terminals (Test Points) to which a voltohmeter can be attached to obtain a reading showing the voltage of the batteries, and another set to show the charging current.

It is another object of the invention to provide a fire protection system which complies with NFPA 72, Genman VDS, and CE approvals.

These and other objects of the present invention are achieved in the preferred embodiments disclosed below by providing a fire protection system for determining the existence of hazardous conditions within a building. The system includes a central monitor node for monitoring and displaying system status information. At least one zone node is located remote from the monitor node, and defines a plurality of fire protection zones within the building. A plurality of detectors are arranged within each zone at respective predetermined address locations. Each of the detectors includes means for detecting and storing information indicating an occurrence of a hazardous event. The detectors have a normal negative state wherein no occurrence of a hazardous event is detected, and a positive state wherein the occurrence of a hazardous event is detected. The zone node includes detector interrogation means for interrogating the plurality of detectors to determine their respective positive or negative states, and for determining the address location for each of the plurality of detectors in a positive state indicating the occurrence of a hazardous event. A communication line electronically interconnects the zone node and the monitor node for relaying information from the zone node to the monitor node indicating the address location for each of the plurality of detectors in a positive state. The address location of all detectors in a positive state is displayed to a system user at the monitor node.

The term "hazardous event" as used herein means any event which may create an actual or potentially dangerous condition within the protected building. For example, such events include, but are not limited to, a fire, the presence of loose metal fragments in ducting which may spark and lead to a fire, and the failure of a detector to operate properly during testing.

BRIEF DESCRIPTION OF THE DRAWINGS

Some of the objects of the invention have been set forth above. Other objects and advantages of the invention will appear as the description proceeds when taken in conjunction with the following drawings, in which:

FIG. 3A shows the monitor display indicating that three zones are in Alarm;

FIG. 3B shows the monitor display indicating Zone #34 (Zone_Name 34) which has 2 Alarms;

FIG. 3C shows the monitor display indicating Alarm event 1 of 2 for Zone #34, the third line of the display being the event string, which is a zone fire detection message, and the last line giving the time and date the event occurred;

FIG. 3D shows the monitor display indicating the second Alarm event for Zone #34, and providing the ID number (59) of one of the detectors that detected the fire;

FIG. 4A shows the Trouble Log displayed, for example, when there are current troubles in the system and no alarms in the system;

FIG. 4B shows the monitor display indicating Trouble in Zone #22 caused by an extinguisher fault;

FIG. 5 shows the monitor display in the System Log which contains the last 350 events that have occurred in the system;

FIG. 6A shows the monitor display in the Self Test Info Log, the fourth line displaying the number of zones passing the self test;

FIG. 6B shows the monitor display in the Self Test Info Log, the fourth line displaying the number of zones failing the self test;

FIG. 6C shows the monitor display in the Self Test Info Log, and indicating that detectors #104 and #108 failed in Zone #22, FIG. 6D shows the monitor display in the Self Test Info Log with the message "Not Enough Detectors" appearing when fewer detector IDs are received from the Self Test than are set on the Number of Detectors switches for the zone;

FIG. 6E shows the monitor display in the Self Test Info Log with the message "Too Many Detectors" appearing when more detector IDs are received from the Self Test than are set on the Number of Detectors switches for the zone;

FIG. 6F shows the monitor display in the Self Test Info Log with the message "More Than 16 Det" appearing when more than 16 detector IDs are received from the Self Test;

FIG. 6G shows the monitor display in the Self Test Info Log with the message "Det Annun line Fault" appearing when a fault is detected on the annunciator line 20 from the detectors;

FIG. 7A shows the system configuration, the second line giving the number of defined zones and the number of installed zones, the third line giving the total number of detectors on all of the installed zones, and the last line showing the current Automatic Self Test configuration;

FIG. 7B shows the configuration information for each of the installed zones;

FIG. 7C shows the known detector IDs installed in the zone;

FIG. 7D shows a list of detectors indicating the detector IDs that were received upon failure of the last self test;

FIG. 8A shows the passed Self Test screen appearing when the system passes the self test; and FIG. 8B shows the failed Self Test screen appearing when the system fails the self test.

DESCRIPTION OF THE PREFERRED EMBODIMENT AND BEST MODE

Figure 1:
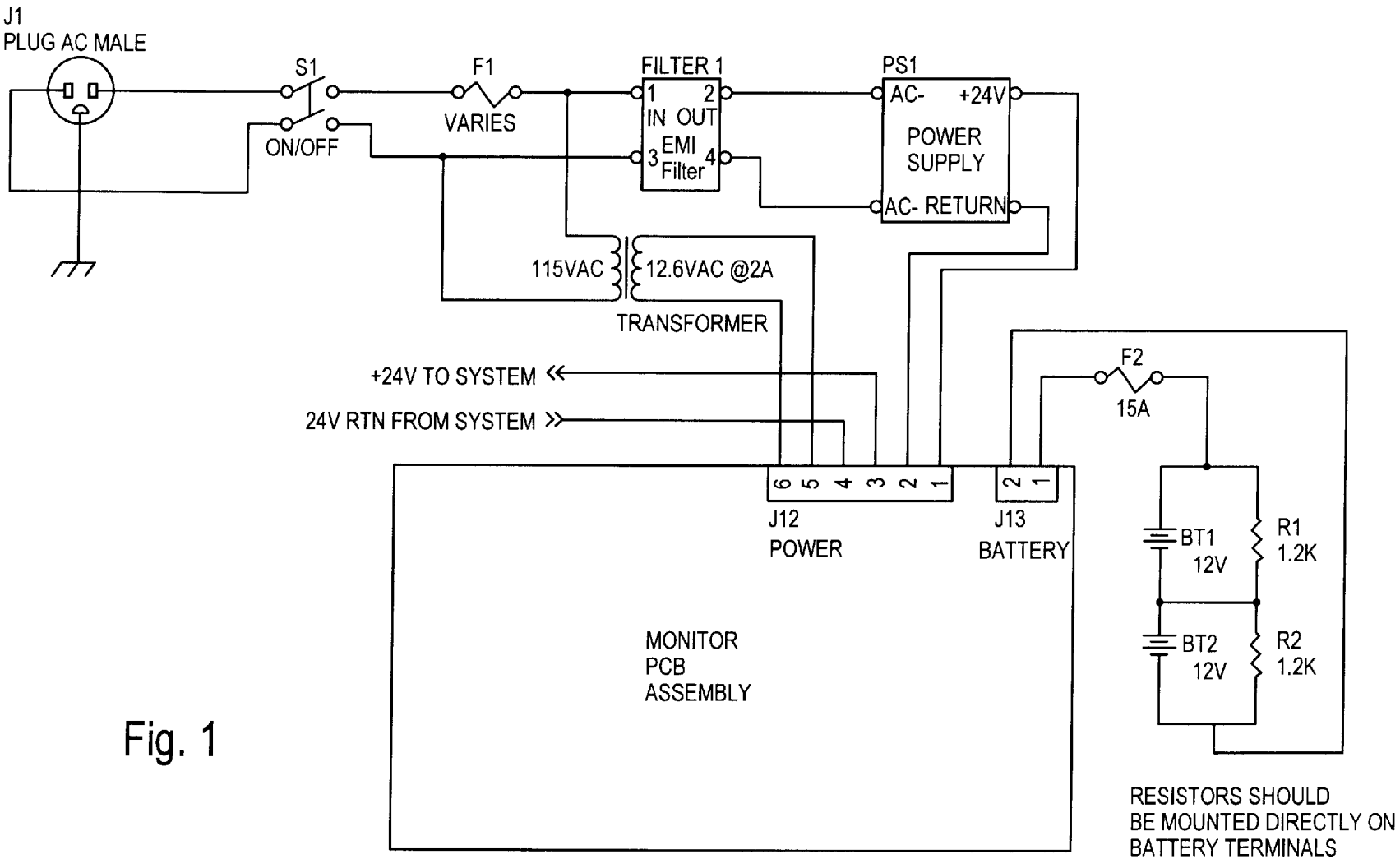
FIG. 1 is an electronic connection diagram illustrating the input section of the fire protection system according to one preferred embodiment of the invention.

Referring now specifically to the drawings, a fire protection system with an A automatic self-test circuit according to the present invention is described below. The system is described in two part the system hardware architecture and the software which controls the operation of the system.

I. Hardware Specification

The following describes the hardware architecture for the fire protection system of the present invention. In particular, hardware descriptions are provided for the monitor assembly, two zone module and ten zone module. These modules form the basis for any configuration of system that may be installed. The single zone module is a derivative of the two zone, and the five zone module is a derivative of the ten zone. The system is designed to provide a high level of protection and ease of use along with advanced features such as self-test and event logging.

The system is built using two or more of tile modules interconnected together to form a system. The base system would be comprised of a two zone module along with a monitor module. The modules within the system are interconnected with a set of cables that carry DC power and the communications between modules.

Each system must contain a monitor module and may be configured with zone modules that will provide up to 99 zones of detectors. Each zone of detectors may have up to 16 detectors. The individual modules will be described in detail in the following sections.

A. Monitor Assembly

The monitor assembly provides several functions within the system. These are:

User interface and control for the system. 24V DC power to the system.

Battery charging and supervision.

Logging of events (both troubles and alarms)

Supervision of the self test feature.

Four discrete outputs for local annunciators. Two for alarms and two for troubles.

Control of up to 9 shut down relays.

Serial communication interface to support either direct connected PC's or modem.

User Interface

The main user interface for the module is a 4 line by 20 character per line VFD display. The display is menu driven by the module software and allows the user to check the system status and view the various events that are present in the system as well as view the event logs. Menu control and selection is made by a four key pad that is located below the display. For a detailed explanation of the user interface please see the software description provided below. Note that the display and the key pad are the only user accessible controls on the module and only allow the system status to be viewed. All other controls are positioned behind the locked panel to prevent the casual user from controlling or hampering the system operation.

Behind the front panel are several discrete controls that are used to set the mode of system operation, or are used in configuring the system. These will be discussed further below.

The display is connected to the monitor module by a 14 pin keyed header-J4. J4 is located in the lower left PCB assembly on the left edge of the card and near the serial port. Pin 1 of the connector is located at the top of the column. Since this is not normally field wired, no connection information is detailed here.

The keypad is connected to the monitor assembly at J3. This is also a keyed header assembly that is located directly above the display connector J4. Once again, this is not normally field wired. Pin 1 of the header is located at the top of the column.

DC Power

The monitor module normally provides the 24VDC that is used to power itself and the rest of the system. This DC power is supplied by a OEM switching power supply mounted in the monitor module enclosure. The power supply has a rating of up to 24VDC at up to 15A DC. The DC power supplied by the power supply is brought directly to the monitor PCB assembly and then distributed to the rest of the system. This is to allow the battery backup circuitry to monitor the status of the power supply and provide backup power in the event of loss of main power. A connection diagram for the input section of the system is shown in FIG. 1.

The switching power supply may be smaller than the 15A maximum value.

The sizing depends on the number and mix of the modules attached as well as the total number of detectors. The approximate power consumption for each type of module is shown below:

| 24 VDC Load | |
|---|---|
| Monitor Module | 125 ma |
| Two Zone | 125 ma |
| Single Zone | 110 ma |
| Ten Zone | 150 ma |

-continued

| 24 VDC Load | |
|---|---|
| Five Zone | 125 ma |
| Detector | 10 ma |
| Top Hat Adapter | 10 ma |
| Relay | 100 ma |
| Extinguisher | <=2000 ma, device dependent |
| Bell | <=2000 ma, device dependent |
| Strobe | <=2000 ma, device dependent |

Base Configuration Example

| | |
|---|---|
| Monitor Node | 125 ma |
| 2 Zone Card w/32 detectors | 125 ma + 160 ma = 285 ma |
| Subtotal | 410 ma Electronics only |

Zone Module Extinguishers/Annunciators

| | |
|---|---|
| 2 Extinguishers | 2 × 500 ma (assumes 500 ma extinguishers) |
| 1 Alarm Strobe | 1 × 500 ma (assumes 500 ma strobe) |
| Subtotal | 1500 ma |

Monitor Modules Annunciators/Relays

| | |
|---|---|
| 1 Relay | 100 ma |
| 2 Strobes | 2 × 500 ma (assumes 500 ma strobe) |
| 1 Bell | 500 ma (assumes 500 ma bell) |
| Subtotal | 1600 ma |

Total System Power =(410+1500+1600)ma=3510 ma

Note in ibis example that about 85% of the system power is used by the extinguishers/bells/and strobes.

Referring to FIG. 1, the power connections are made to the barrier strip labeled J12 which is located at the top of the boards. A copy of the silk screen for the monitor card is shown below. Looking at the board with serial DB9 connector in the lower left hand corner, pin 1 of the barrier strip is the rightmost terminal. The pin out for the DC power connector is shown below:

J12 (DC Power) Pin Out

| Pin # | Name | Function |
|---|---|---|
| 1 | +24 V IN | +24 V from power supply. |
| 2 | RTN IN | +24 V Return from power supply. |
| 3 | +24 V OUT | +24 V to rest of system. |
| 4 | RTN OUT | +24 V Return to rest of system. |
| 5 | CHARGE | 12.6 VAC from battery charger transformer. |
| 6 | CHARGE | 12.6 VAC from battery charger transformer. |

The CHARGE inputs are from the battery charger transformer and are only used on systems that use battery backup. Note that the 12.6VAC connections are fused on the PCB assembly at 2 Amps. This fuse is labeled F4 and is located directly below the J12 connector. The PCB assembly has a main 6A fuse F3 which is located at the top center of the PCB.

Battery Charging and Supervision

The monitor node provides for the charging, transfer switching, and supervision of lead acid type batteries for the system. In a normal configuration, two 12V sealed lead-acid batteries are connected in series with individual load resistors. The battery is connected to J13 on the monitor card. Note that the battery connection should use an in-line fuse in the wiring between the battery and the terminals on the board. J13 is located on the top right of the board when oriented as shown in FIG. 1. Pin 1 is the rightmost terminal. Connection for the battery pack is detailed below. J13 (Battery) Pin Out

| Pin # | Name | Function |
|---|---|---|
| 1 | VBAT+ | +24 VDC from battery. |
| 2 | VBAT− | Battery return. |

The battery charge circuit is a multiple stage charger that uses three distinct modes to charge the battery. When the batteries are completely discharged the charger uses a small (10 ma) trickle charge to condition the batteries until the cell voltage has reached at least xxxx volts. Once this threshold has been reached the charge begins delivering a constant current charge of 2A to bulk charge the cells. This continues until the cell voltage reaches a threshold of xxxx volts. At this point the charger holds a constant voltage on the cells and allows the charge current to go to the level necessary to replace the current used in the battery load resistors. The charger has three LED's that indicate the state of the batteries. These are located in the middle of the board These are listed below in top to bottom order.

| LED Position | Name | Function |
|---|---|---|
| Top Green | FULL CHG | Indicates that the batteries are at full charge. |
| Lower Green | CHARGE | Indicates that the batteries are being charged. |
| Top Yellow | DISCHARGE | Indicates that the batteries are in discharge mode. |

Note that any time that the CHARGE LED goes out, the system trouble should be illuminated and the display should indicate a problem with the battery.

Logging of Events

The monitor module provides the real time dock for the system and constantly maintains communications with the various other modules within the system to guarantee that they are functional and capable of communication. Whenever an alarm or trouble is reported by the system, the monitor will activate the annunciators, log the event in the appropriate log, and post a message on the display. A detailed description of these logs is given in the software description below. During an event, the module that initiated the event will turn on its local trouble or alarm outputs (based on the type of event). Any node event will also cause a system trouble and/or alarm to be activated on the monitor node and the monitor node will send a message to all nodes in an alarm condition to activate the system alarm output that is present on all the zone modules.

Self Test

The monitor node is responsible for invoking the self test feature, logging the results, and reporting any malfunctions. When the unit is shipped there is no scheduled self test. Any self test is invoked by pressing on the pushbutton, S2. This is the leftmost switch in a bank of two located approximately two inches above and to the right of the serial connector. It is labeled Self Test. When this button is pushed, the system will perform a test of all zones (zone by zone) of the system and report any detectors that did not function properly. The result of this test is logged in the self test log. Any malfunctions will cause the local and system trouble annunciators to be activated.

A schedule for self test can be programmed and down loaded to the monitor module from a system PC program. This program will remain in effect until changed by the PC program.

System Annunciators and Power Supply Trouble

The monitor module provides four annunciator outputs. Each of these outputs can drive up to a 2A load. There are two sets of outputs. Each set has two outputs, one for a bell (siren) and one for a strobe. In addition to these outputs, there are two LED's located near the center of the PCB that will indicated a system alarm or trouble. The SYS ALM LED (LED6) is red and will light whenever there is a system alarm. The SYS TRBL LED (LED7) is yellow and is located directly below the SYS ALM LED. It will turn on for any system trouble.

Both of the ALARM outputs are activated on any system alarm condition. The alarm siren output is labeled J8 and is located on the right side of the PCB approximately half way up the card. The alarm strobe output J9) is located directly below the alarm siren output The siren output can be disabled using the ALR SILENCE toggle switch which is located directly to the left of the output terminals. Putting this output in silence causes a system trouble indication. This will act as a normal trouble except that in addition, the yellow LED labeled ALM SUP (LED 9) Will turn on. This LED is located near the center of the PCB just to the right and slightly above the SELF TEST pushbutton. These outputs are protected by a 2A fuse F2 which is located directly left of the connectors.

Both of the TROUBLE outputs are activated on any system trouble indication. The trouble siren output is labeled J6 and is located directly below the alarm strobe output. The trouble strobe output is labeled J7 and is located below J6. Once again, the siren output may be silenced by throwing the TRBL SILECE switch. This switch is located directly to the left of the Trouble Siren Output. This will place the system in trouble mode. This will act as a normal trouble except that in addition, the yellow LED labeled TRBL SUP (LED 9) will turn on. This LED is located near the center of the PCB just to the right and slightly above the SELF TEST pushbutton. These outputs are protected by a 2A fuse F1 which is located directly left of the connectors.

All of the outputs are supervised outputs meaning that with no load connected, the system will be in trouble. If an output is not used, then a 1K ohm resistor should be placed across the terminals of the output. No polarity is normally required, however for those devices that are phase sensitive, PIN 1 of each connector is the most positive terminal. PIN 1 is the bottommost connector on each connector.

All modules in the system have a discrete input that is labeled PS_TBL. This is a general purpose input that may be activated by closing a switch across the terminal. Placing a short between the two terminals of this connector J10) located directly above the SYSTEM ALARM outputs causes the system to log a POWER SUPPLY TROUBLE to the system. In practice this may be used to monitor security switches on the doors of the modules, supervise remote power supplies, or act as a general purpose input to indicate trouble. The switch used to activate is input need only have a rating of 5VDC at 1ma. Whenever this input is shorted the system will go into trouble, and the PS TRBL LED (LED12) located below the DISCHARGE LED will be illuminated.

Shut Down Relays

The monitor node is capable of driving up to nine shut down relays. These are driven by constant current drivers with currents of 150 ma. These drivers are pulled up to 24V. The constant current nature of the drivers prevents a short circuit on one of the loads interrupting another outputs drive. The relay outputs are connected to the PCB using the 10 pin removable connector p11) labeled SHUTDOWN RELAYS. This is located in the bottom right of the PCB assembly. The pin out for the connector is shown below. J11 (SHUTDOWN RELAYS) Pin Out

| Pin # | Name | Function |
|---|---|---|
| 1 | RELAY 1 | Switched output to relay #1. |
| 2 | RELAY 2 | Switched output to relay #2. |
| 3 | RELAY 3 | Switched output to relay #3. |
| 4 | RELAY 4 | Switched output to relay #4. |
| 5 | RELAY 5 | Switched output to relay #5. |
| 6 | RELAY 6 | Switched output to relay #6. |
| 7 | RELAY 7 | Switched output to relay #7. |
| 8 | RELAY 8 | Switched output to relay #8. |
| 9 | RELAY 9 | Switched output to relay #9. |
| 10 | RLYRTN | Relay return, common to all outputs. |

The individual zone modules are configured to select which of the relays to activate in the case of an alarm.

Serial Communication

The system is capable of being installed and operated without the use of a PC, however, support for either a local, direct connected PC or one connected via a modem is supported. The connection is made using the DB-9 connector located in the lower left of the PCB assembly. This connector is pinned out to match a PC's serial port and will connect to the PC using a NULL MODEM cable. Connection to a modem would be with a standard straight through modem cable. The pin outs are shown below. J5 (PC/MODEM) Pin Out

| Pin # | Name | Function |
|---|---|---|
| 1 | DCD | Data Carrier Detect |
| 2 | SIN | Serial In |
| 3 | SOUT | Serial Out |
| 4 | DTR | Data Terminal Ready |
| 5 | GROUND | Ground. |
| 6 | DSR | Data Set Ready |
| 7 | RTS | Ready to Send |
| 8 | CTS | Clear to Send |
| 9 | RI | Ring Indicator |

Note that all the standard modem control lines are supported.

The serial connection has four GREEN LED's that are above and to the left of the SELF TEST switch. The top LED shows that the PC/or MODEM has connected. The next two LED show communication status. The upper one is RECEIVE, and LOWER one is TRANSMIT. These will flash whenever a packet is processed. The lowest LED of the four is a heartbeat LED that flashes at a 1 Hz rate whenever the unit is operating normally.

Other Controls

There are two other controls on the unit. The first control is actually configured as two rotary switches labeled NUMBER OF ZONES. These switches must be set to the number of active zones configured within the system. The allowable range is 01 to 99. This is the only configuration control on the monitor module.

The final control is the ALM RESET pushbutton which is located to the right of the SELF TEST pushbutton. This control resets the system from a detector induced alarm and must be pushed to reset the system and bring it out of alarm. This is not true for alarms that are induced on zones with addresses in the range of 76–99. These zone addresses are reserved for non-latching switch devices which require no direct reset.

"LonWorks" Network Connection

The monitor module is connected to all other assemblies using a twisted pair communication channel. Connection is made using the plug-in Wiedmueller connector. Normally the mating connector would be a "T" style connector that allows the daisy chain to remain connected while the board is replaced. The network may be wired in any topology (star, ring, bus) or combinations of topologies. The only criteria is that the total length of the bus be limited to 500 meters. If longer lengths are desired, then network may be wired as a bus (serpentine, no branches) then the total length of the bus can be 2700 meters. The pin outs for the network connector is shown below. Pin 1 for the connector is the bottom most pin. When making the connections, the network connections are phase sensitive, so COM A should always be connected to a COM A terminal and so forth. J1 (COM) Pin Out

| Pin # | Name | Function |
|---|---|---|
| 1 | COM A | Network A |
| 2 | COM B | Network B |
| 3 | GND | Shield |

There is no need for shielded cable. However, there is sometimes a user requirement for communications cables having shields so provisions may be made to support that type of cable. The suggested wire types for use in the system for the network connections are:

Belden 85102, Single twisted pair, stranded 19/29 (16AWG), unshielded, 150';

Belden 8471, Single twisted pair, stranded 19/29(16 AWG), unshielded 60';

Level IV 22AWG, twisted pair, typically solid and unshielded; and

JY (St) Y 2×2×0.8, 4 wire helical twist, solid, shielded.

Note that for shielded wire, the shield must be connected to pin 3 of the connector J1.

B. Two Zone Module

The two zone module provides support for up to two zones of detectors. The zone has two physical zones, Zones 1 and 2. ZONE 1 provides support for up to 16 detectors and two extinguishers. ZONE 2 provides support for up to 16 detectors and one extinguisher. Besides zone support, the module has three outputs that are event driven. It also has a discrete binary input. Throughout this section, whenever references are made to physical locations, the board is assumed to be oriented with the connector strips on the right side of the board. The board is powered from +24VDC that is supplied through the four position Weidmueller connector j3 located at the top center of the PCB. The pin out for J3 is shown below.

J3 (POWER) Pin Out

| Pin # | Name | Function |
|---|---|---|
| 1 | +24 V | 24 VDC from power daisy chain. |
| 2 | +24 V | 24 VDC from power daisy chain. |
| 3 | RTN | Return for the 24 VDC |
| 4 | RTN | Return for the 24 VDC |

Pin 1 is the top most pin of the connector. The PCB is protected on the +24VDC lines with a 6 amp fuse F1 located at the directly adjacent to J3.

The board interconnects with the other modules on the twisted pair network that is brought onto the board using the 3 pin Weidmueller connector J2. The pin out for this connector is indicated below. Pin 1 for the connector is the bottom most pin. When making the connections, the network connections are phase sensitive, so COM A should always be connected to a COM A terminal and so forth.

J2 (COM) Pin Out

| Pin # | Name | Function |
|---|---|---|
| 1 | COM A | Network A |
| 2 | COM B | Network B |
| 3 | GND | Shield |

Zone 1 Description

Zone 1 is the uppermost zone on the PCB. The zone will support up to 16 detectors and two extinguishers. A test lamp output is also driven to be used in self test. The detectors used must be either 244 detectors, or 242,243 detectors using the top hat adapter assembly. The detectors are wired in daisy chain fashion, A standard end of line module is needed at the end of the detector chain farthest away from the panel. Connection of the detector chain is made via a 5 pin removable connector J5 located about midway up the right side of the PCB. The pin out for the connector is shown below. J5 (Z1 Detectors) Pin Out

| Pin # | Name | Function |
|---|---|---|
| 1 | AN IN | Annunciator input from detector string |
| 2 | DET+ | +24 V to detector string |
| 3 | DET IN | Fire signal from detector string |
| 4 | DET– | 24 V return from detector string |
| 5 | GND | Ground connection from detector string |

Note that Pin 1 is the bottom pin on the connector.

Two extinguishers are supported. Each extinguisher output can drive up to 2A and is individually fused with a 2A fuse. Fuse F2 protects EXT1 and Fuse F3 protects EXT2. Both fuses are located adjacent to the extinguisher connectors. Connection for the first extinguisher is made using the 2 pin removable connector J4(Z1 EXT1) located about one inch above the detector string connector. Connection to the second extinguisher is made via the removable connector J6 (Z1 EXT2) located directly above J4. Both of these outputs are supervised and require a 1K ohm resistor to be placed across the terminals if not used to bring the zone out of trouble. Pin 1 is the bottom pin on both extinguisher connectors and is the most positive for polarity sensitive loads.

Zone 2 Description

Zone 2 is the lower zone on the PCB. The zone will support up to 16 detectors and a single extinguisher. A test lamp output is also driven to be used in self test The detectors used must be either 244 detectors, or 242,243 detectors using the top hat adapter assembly. The detectors are wired in daisy chain fashion. A standard end of line module is needed at the end of the detector chain farthest away from the panel. Connection of the detector chain is made via a 5 pin removable connector J10 located at the bottom right edge of the PCB. The pin out for the connector is shown below.

J10 (Z2 Detectors) Pin Out

| Pin # | Name | Function |
|---|---|---|
| 1 | AN IN | Annunciator input from detector string |
| 2 | DET+ | +24 V to detector string |
| 3 | DET IN | Fire signal from detector string |
| 4 | DET– | 24 V return from detector string |
| 5 | GND | Ground connection from detector string |

Note that Pin 1 is the bottom pin on the connector.

A single extinguisher is supported. The extinguisher output can drive up to 2A and is fused with a 2A fuse F4. It is located adjacent to the Z2 EXT1 connector. Connection to the extinguisher is made using the 2 pin removable connector J9 (Z2 EXT1) located about one inch above the detector string connector. The extinguisher output is supervised and will require a 1K ohm resistor to be placed across the terminals if not used to bring the zone out of trouble. Pin 1 is the bottom pin on the extinguisher connector and is the most positive for polarity sensitive loads.

Zone 1 Controls

Each zone has a set of controls to configure and set the mode for the zone.

The controls and their description is given below.

| Control | Description |
|---|---|
| Z1 EXT1 DIS | Zone 1 extinguisher 1 disable, disables extinguisher 2 output and causes zone to go into trouble. |
| Z1 EXT2 DIS | Zone 1 extinguisher 2 disable, disables extinguisher 1 output and causes zone to go into trouble. |
| Z1 DET RES | Zone 1 Detector Reset. This is a momentary toggle switch that removes power from the detector string and resets the detectors locally. |
| Z1 RELAY | Ten position rotary switch. Sets the shut down relay to be activated on the monitor module in the event of an alarm on zone 1. |
| Z1 ADDRESS | Two ten position rotary switches located next to the relay control. These set the address for the zone. Allowable address are 01–99. Setting a zone address to 00 disables the zone. |
| Z1 DETECTOR | Two ten position rotary switches located directly beneath the zone address switches. These set the number of detectors on the zone. Allowable settings are 01–16. |

The extinguisher disable switches are located adjacent the fuses for each output and the reset switch is located beneath the disables and to the left of the detector connector.

Zone 2 Controls

The controls for Zone 2 are similar to the Zone 1 controls except there is only one extinguisher disable switch. The controls and their description is given below.

| Control | Description |
|---|---|
| Z2 EXT1 DIS | Zone 2 extinguisher 1 disable, disables extinguisher 1 output and causes zone to go into trouble. |
| Z2 DET RES | Zone 2 Detector Reset. This is a momentary toggle switch that removes power from the detector string and resets the detectors locally. |
| Z2 RELAY | Ten position rotary switch. Sets the shut down relay to be activated on the monitor module in the event of an alarm on zone 2. |
| Z2 ADDRESS | Two ten position rotary switches located next to the relay control. These set the address for the zone. Allowable address are 01–99. Setting a zone address to 00 disables the zone. |
| Z2 DETECTOR | Two ten position rotary switches located directly beneath the zone address switches. These set the number of detectors on the zone. Allowable settings are 01–16. |

The extinguisher disable switches are located adjacent the fuses for each output and the reset switch is located beneath the disables and to the left of the detector connector.

Other Inputs, Outputs, and Indicators

The 2 zone module has three outputs as well as three on-board LED's that indicate local and/or system status. The outputs are rated at 2A drive capability and are available at the J1(ANNUNCIATOR) connector located at the top right of the PCB. Each of these outputs is a FET output that will pull the load to ground. A common +24V pin acts as the positive connection for all three outputs. The pin out for J1 is shown below.

J1 (ANNUCIATOR) Pin Out

| Pin # | Name | Function |
|---|---|---|
| 1 | +24 V | Common positive feed for all output loads. |
| 2 | NOD TRBL | Node trouble, enabled when a trouble condition exists at this module. A node trouble also illuminates the yellow LED1 located near the ANNUCIATOR connector. |
| 3 | NOD ALM | Node alarm, enabled when a alarm condition exists at this module. A node alarm also illuminates the red LED 2 located above LED1. |
| 4 | SYS ALM | System alarm, enabled whenever an alarm condition exists anywhere in the system. This output could be used for remote shut down relays. A system alarm also illuminates the red LED3 located above LED2. Note that Pin 1 is the bottom pin on the connector. All LED's will flash at a 1 Hz rate when they are illuminated. The individual zones also have a set of LED's that are located adjacent to the zones. These are arranged in a column of three LED's. Their definitions are shown below. top most LED is given first. The alarm and trouble LED's will flash at a 1 Hz rate when illuminated. |

| LED Label | Description |
|---|---|
| ZX FIRE | Zone Alarm(RED). Indicates an alarm condition on this zone |
| ZX TRBL | Zone Trouble(YELLOW). Indicates a trouble condition on this zone. |
| ZX PWR | Zone Power(GREEN). Indicates that power is available to the detector string. |

The zone also supports a single discrete input similar to the monitor module labeled $PS_{13}$ TBL. This input will take a switch closure and cause a trouble indication to be issued.

Specifically, the trouble will be logged as power supply trouble. The input was designed to allow a zone module to be powered by a remote battery backed power supply. To use the input in this configuration, a coil of a relay would be driven by the remote power supply. The normally closed contacts of the relay would then be connected across the pins of connector J8 located near the top right edge of the board. Once the local supply lost power, the node would still have enough hold up time to issue a power supply trouble report to the system. Note that whether this input is used or not, the system will recognize the loss of power to the module since the modules heartbeat message would be dropped and the monitor module would know the node was in trouble.

C. Ten Zone Module

The ten zone module is functionally equivalent to the 2 zone with the exception that 10 zones are supported rather than two. On the 10 zone module, zones 1 and 6 have support for two extinguishers while all other zones support a single extinguisher. Throughout this section, whenever references are made to physical locations, the board is assumed to be oriented with the connector strips on the sides of the PCB and with the PCB silk screen label at the bottom of the board. Zones 1 through 5 are located on the right side of the PCB and zones 6 through 10 are located on the left edge of the PCB.

The ten zone module provides support for up to ten zones of detectors. The module has ten physical zones, Zones 1–10. ZONES 1 and 6 support for up to 16 detectors and two extinguishers. All other zones provides support for up to 16 detectors and one extinguisher. Besides zone support, the module has three outputs that are event driven. It also has a discrete binary input. The board is powered from +24VDC that is supplied through the four position Weidmueller connector J3 located at the top center of the PCB. The pin out for J3 is shown below.

J3 (POWER) Pin Out

| Pin # | Name | Function |
|---|---|---|
| 1 | +24 V | 24 VDC from power daisy chain. |
| 2 | +24 V | 24 VDC from power daisy chain. |
| 3 | RTN | Return for the 24 VDC |
| 4 | RTN | Return for the 24 VDC |

Pin 1 is the top most pin of the connector. The PCB is protected on the +24VDC lines with a 6 amp fuse F1 located at the directly adjacent to J3.

The board interconnects with the other modules on the twisted pair network that is brought onto the board using the 3 pin Weidmueller connector J2. The pin out for this connector is shown below. Pin 1 for the connector is the bottom most pin. When making the connections, the network connections are phase sensitive, so COM A should always be connected to a COM A terminal and so forth.

J2 (COM) Pin Out

| Pin # | Name | Function |
|---|---|---|
| 1 | COM A | Network A |
| 2 | COM B | Network B |
| 3 | GND | Shield |

All functions for the board are similar to the two zone module described above. The connector pin outs are shown below. Note that for zones 1–6 the pin outs are similar to the two zone module while for zones 6–10, the pin outs are reversed so that the wiring will be symmetrical about a center vertical axis.

DETECTOR STRINGS, ZONE 1–5 PIN OUT (J5, J10, J18, J21, J24)

| Pin # | Name | Function |
|---|---|---|
| 1 | AN IN | Annunciator input from detector string |
| 2 | DET+ | +24 V to detector string |
| 3 | DET IN | Fire signal from detector string |
| 4 | DET– | 24 V return from detector string |
| 5 | GND | Ground connection from detector string |

Pin 1 is the bottom pin of the connector.

DETECTOR STRINGS, ZONE 6–10 PIN OUT J13, J27, J30, J33, J36

| Pin # | Name | Function |
|---|---|---|
| 1 | GND | Ground connection from detector string |
| 2 | DET– | 24 V return from detector string |
| 3 | DET IN | Fire signal from detector string |
| 4 | DET+ | +24 V to detector string |
| 5 | AN IN | Annunciator input from detector string |

Pin 1 is the top pin of the connector.

All two pin outputs on zones 1–5 are similar to the two zone module, the most positive pin for the output is pin1 on these connectors and is the bottom pin on each connector.

All two pin outputs for zones 6–10 have the most positive pin for the output as pin 2 on these connectors and is the bottom pin on each connector.

The annunciator outputs (NODE TROUBLE, NODE ALARM, and SYSTEM ALARM) are located on connector J1 and have connections and function identical to the two zone module. The pin out is show below. J1 (ANNUCIATOR) Pin Out

| Pin lvgb # | Name | Function |
|---|---|---|
| 1 | +24 V | Common positive feed for all output loads. |
| 2 | NOD TRBL | Node trouble, enabled when a trouble condition exists at this module. A node trouble also illuminates the yellow LED1 located near the ANNUCIATOR connector. |
| 3 | NOD ALM | Node alarm, enabled when a alarm condition exists at this module. A node alarm also illuminates the red LED 2 located above LED1. |
| 4 | SYS ALM | System alarm, enabled whenever an alarm condition exists anywhere in the system. This output could be used for remote shut down relays. A system alarm also illuminates the red LED3 located above LED2. |

II. Software Description

The system is composed of two types of nodes: the Monitor node and the Zone node. As a minimum, a system must contain one Monitor node and one Zone node. Only one Monitor node is supported in a system, while up to 50 Zone nodes are supported. The system supports a maximum of 99 zones and up to 16 detectors per zone for zones 1 through 75. Zones 76 through 99 support up to 100 detectors per zone.

A. System Operation

Monitor Node

The Monitor node is the main controller and user interface for the system. This node allows the user to view the current state of the system, the system log, the last self test information, and the current system configuration.

Front Panel Pushbuttons

There are four pushbuttons located on the front panel of the Monitor node that are used for navigating the user interface. See the Monitor Display section below for specific examples on the use of these buttons.

| | |
|---|---|
| "Prev" | Moves to the previous log entry |
| "Next" | Moves to the next log entry |
| "More" | If on the top level of a menu, moves to the lower level<br>If on the lower level of a menu, moves to the top level |
| "Log Select" | Moves to the next main menu |

Monitor Display

The user interface for the system is used for monitoring the current status and history of the system. No passwords are needed to operate the interface since no programming or configuration changes can be made from the Monitor node. The system PC program must be used to customize the zone names, set the time and date, and program the automatic self test. The display for the Monitor node is a 4-line by 20 character Vacuum Fluorescent Display(VFD).

(1) Main Screen

Figure 2A:
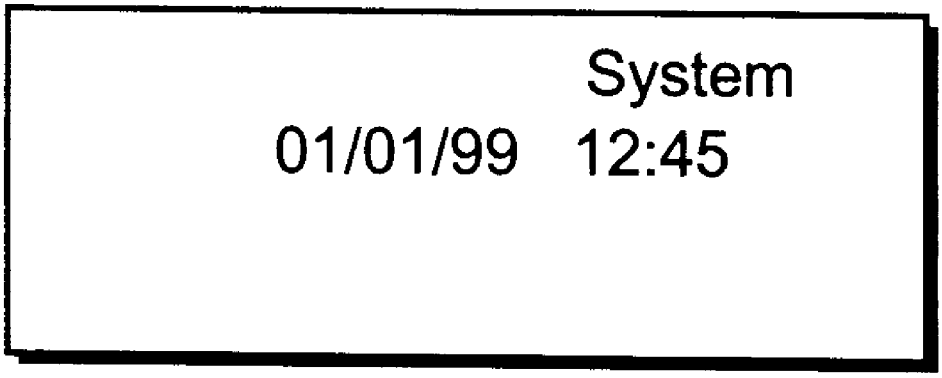
FIG. 2A shows the main screen of the monitor display.

The main screen of the Monitor display shown in FIG. 2A. This screen is only visible when the system has no current alarms or troubles, and indicates that the system is operating normally.

Figure 2B:
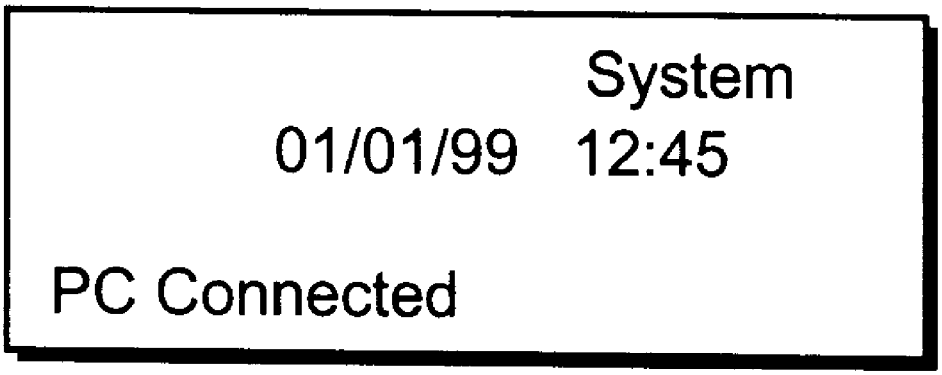
FIG. 2B shows the bottom line of the main screen changed to indicate an active connection when the PC program is communicating to the Monitor node via serial or modem connection.

When the PC program is communicating to the Monitor node via serial or modem connection, the bottom line of the main screen changes to indicate that the connection is active. This is indicated in FIG. 2B.

(2) Alarm Log Referring to FIGS. 3A–3D, whenever there are current alarms in the system, the Main Screen is replaced by the Alarm Log screen. The Log Select key is disabled while the System is in alarm so that the Alarm Log screen is always visible. The Alarm Log screen has two levels. The top level shows the list of zones that are in Alarm. The display shown in FIG. 3A indicates that 3 zones are in Alarm. The first of the 3 zones is Zone #22 ($Zone_{13}$ Name 22)which has 3 Alarms.

The "Next" and "Prev" keys are used to move between the zones in this level.

Pressing the "Next" key moves to the next zone in Alarm. As indicated in FIG. 3B, this zone is Zone #34 ($Zone_{13}$ Name 34) which has 2 Alarms.

Pressing the "More" key while viewing a zone in the top level moves to the second level which shows more detail about the Alarm events for the zone. The display in FIG. 3C shows Alarm event 1 of 2 for Zone #34. The third line of the display is the event string, which is a zone fire detection message. The last line gives the time and date the event occurred.

The "Next" and "Prev" keys are used to move between the Alarm events for this zone. As shown in FIG. 3D, for example, pressing the "Next" key moves to the second Alarm event for Zone #34. This event gives Me ID number (59) of one of the detectors that detected the fire. Pressing the More key here returns to the top level for this zone.

(3) Trouble Log

Referring to FIG. 4A, the Trouble Log is displayed when there are current troubles in the system and no alarms in the system. The "Log Select" key is enabled while the system is in trouble, however the display will return to the Trouble Log screen if the front panel pushbuttons are inactive for 20 seconds. The Trouble Log screen has 2 levels. The top level shows the list of zones that are in trouble. As with the Alarm log, the Next and Prev keys move between the zones in the Trouble Log.

Pressing the "More" key moves to the second level, which gives more detail on the trouble events in the selected zone. In his example, the Trouble in Zone #22 is caused by an extinguisher fault. See FIG. 4B. To return to the top level of the Trouble Log, the "More" key is pressed again.

(4) System Log

Pressing the "Log Select" key once while viewing the Main Screen or the Trouble Log will access the System Log screen. As shown in FIG. 5, the System Log contains the last 350 events that have occurred in the system. When the System Log is first selected, the display will show the most recent event in the log. The "Next" and "Prev" keys are used to move between the events in the System log. The "More" key has no effect in this log.

(5) Self Test Info Log

Referring to FIGS. 6A–6G, the Self Test Info Log is accessed by pressing the "Log Select" key from the System Log screen. This log contains the information from the last self test performed on the system. The third line indicates the initiator of the test: Manual for Self Test pushbutton, Auto for Automatic Self Test, or Remote for PC program. If all zones passed the self test, the fourth line displays the number of passing zones (See FIG. 6A).

If one or more zones failed the self test, the fourth line gives the number of failing zones. This is shown in FIG. 6B.

Pressing the "Next" key moves to screens showing the failed detector numbers on the failing zones. The screen shown in FIG. 6C indicates that detectors #104 and #108 failed in Zone #22.

Before a successful Self Test has been completed on a zone, the system does not know the detector ID numbers of the detectors in the zone. The messages shown in FIGS. 6D–6G help the installer determine the cause of the failures. The System Config Log, described below, will display the passing detector IDs after a failed Self Test. The message "Not Enough Detectors" appears when fewer detector IDs were received from the Self Test than are set on the Number of Detectors switches for the zone. This is indicated in FIG. 6D.

The message "Too Many Detectors" appears when more detector IDs were received from the Self Test than are set on the Number of Detectors switches for the zone. This is indicated in FIG. 6E.

The message "More Than 16 Det" appears when more than 16 detector IDs were received from the Self Test. This can occur if more than 16 detectors are connected to a zone or if the annunciator line from the detectors is intermuttendy shorted to another wire. This is indicated in FIG. 6F.

The message "Det Annun Line Fault" appears when a fault has been detected on the annunciator line from the detectors. This usually occurs if the annunciator line is shorted to 24V or if the mode selection jumper on a new detector is incorrectly set. This is indicated in FIG. 6G.

(6) System Config Log

Referring to FIGS. 7A–7D, the System Config Log is accessed by pressing the "Log Select" key while viewing the Self Test Info Log. This log contains a summary of the current configuration of the system and each of the zones. FIG. 7A shows the system configuration. The second line gives the number of defined zones and the number of installed zones. These numbers will be the same when the system is not in Trouble. The third line gives the total number of detectors on all of the installed zones. The last line shows the current Automatic Self Test configuration. In the present example, the Automatic Self Test is set to run at 1:45AM every Monday, Wednesday, and Friday.

Pressing the "Next" key shows the configuration information for each of the installed zones, as indicated in FIG. 7B. This information is from the switch settings for the zone on the zone node.

Pressing the "More" key displays the known detector IDs installed in the zone, as indicated in FIG. 7C. After a successful Self Test has been performed, the screen shows all of the detectors in a zone. The top line displays "SYSCFG OK-(22)" which indicates that Zone #22 has no configuration Troubles. The following list of detector numbers functioned correctly during the last Self Test.

Referring to FIG. 7D, if the last self test failed, the list of detectors shows the detector IDs that were received. The top line displays "SYSCFG TBL-(22)" which indicates that Zone #22 has configuration troubles. The following list of detectors was identified during the last Self Test. If detectors failed the latest test but passed an earlier test, the failed detector numbers can be found in the Self Test log discussed above. This list of detectors is useful for debugging when installing a zone for the first time.

Board Level I/O (1) System Alanm Reset pushbutton

The System Alarm Reset pushbutton resets every zone in the system, including zones that have their Zone Number set to 00. The Alarm Log is also cleared.

(2) Self Test pushbutton

The Self Test pushbutton performs the configuration checkout and test function in the system. First, the Monitor reads the latest configuration information from the zone nodes in the system. The new information is processed to add any new zones and delete zones that have been removed from the system. The system then begins the self testing process starting with the lowest valid zone number to test the detectors in the system. Each installed zone is tested with any failure information stored in the Trouble Log and Self Test Info Log.

(3) Alarm and Trouble Outputs

The Monitor provides two Alarm outputs for alarm annunciators. Both Alarm outputs are enabled whenever any zone in the system is in alarm. The outputs are reset when the System Alarm Reset button is pressed. One of the Alarm outputs can be disconnected by the Alarm Silence toggle switch.

The Monitor also provides two Trouble outputs for trouble annunciators. Both Trouble outputs are enabled whenever any zone in the system is in trouble except when the system is operating on battery backup power. The outputs are reset when all troubles in the system are cleared. One of the Trouble outputs can be disconnected by the Trouble Silence toggle switch.

The Monitor node supervises all of the Alarm and Trouble outputs. Trouble is reported in the System zone when these outputs are unsupervised.

(4) RS-232 Port

A 9-pin RS-232 port is provided for connection to a PC or external modem. A straight-through serial cable is used to connect to a local PC serial port for use with the system PC program. A null modem serial cable is used to connect to a local modem.

Zone Node

The Zone Node provides the fire protection zones for the system. Each zone on a Zone Node is a fully functional fire protection circuit with inputs from a detector string, one or two outputs to fire extinguishers, and a test lamp output. The Zone Node also has an individual reset switch and extinguisher disconnect switch. The Zone Node also has switches to set the zone number, number of zones, and shutdown relay number. The Zone Node will detect and extinguish fires regardless of the settings of the zone switches.

The Zone Node has the following 3 annunciator outputs for local connection of warning devices:

| | |
|---|---|
| "System Alarm" | This output is activated when an alarm occurs anywhere is the system. |
| "Node Alarm" | This output is activated when an alarm occurs in a zone on this node. |
| "Node Trouble" | This output is activated when a trouble occurs in a zone on this node. |

Detector ID Modules

The detectors used with the system have incorporated new circuitry to provide a 7-bit identification number for each detector. This provides 128 unique ID numbers for the detectors. Each zone supports up to 16 detectors. The detectors in a zone must have unique ID numbers for the detector ID function to operate.

B. System Setup

Monitor Node Settings

The Monitor node provides only 1 set of user-settable switches. These switches set the number of zones that are present in the system. The Monitor will report trouble if the switch setting does not match the number of zones detected in the system during a configuration check.

Zone Node Settings

The Zone node has 3 sets of switches for each zone on the node.

Zone Number Switches

The Zone Number Switches are used to assign an address to the associated zone circuitry. A setting of 00 indicates that the zone is disabled or not used. This setting does NOT disable the hardware, it only disables the zone reporting in the Monitor node. A zone that is set to 00 will extinguish fires in the zone but will not store messages in the log, activate a shutdown relay, or enable any alarm or trouble annunciators.

The zone number can range from 1–99 but must be unique in the system. Since this number is used to store and report events associated with a physical zone, the system will only allow one occurrence of a zone number in the system.

The zone numbers 76–99 are special zones with self clearing alarms. These zones are for devices other than normal IR detectors. The zone will operate as a normal zone when a fire signal is received from the input; the extinguisher will discharge, alarm messages will be posted on the Monitor display, and the selected shutdown relay will be activated. The zone will reset automatically if the fire signal changes to the inactive state. The zone can also be reset by the local alarm reset switch or by the System Alarm Reset switch.

Number of Detector Switches

The Number of Detector Switches set the number of detectors present in the detector string for the zone. This number is used during the Detector Self Test to verify that the detector string is operating correctly. A setting of 00 disables self testing for the zone. The number of detectors can range from 1–16. A setting of >16 will put the zone in trouble until the switches are changed to the valid range.

Relay Number Switch

The Relay Number Switch assigns a shutdown relay on the Monitor node to the zone. When a fire is detected in the zone, the assigned shutdown relay on the Monitor node will be engaged. The relay will stay engaged until a System Alarm Reset is performed. A setting of 0 indicates that no shutdown relay is assigned to the zone.

Installation Procedure

The system nodes should be connected as described above in the Hardware Specification. It is recommended that the zones be added and checked out one at a time.

To add a zone to a system, follow these steps:

(1) Determine the number of detectors required for the zone.

(2) Make sure that the detectors have unique ID numbers.

(3) Wire the detectors, extinguisher, and test lamp to the zone node per the Hardware Specification.

(4) Set the Number of Detectors switches for the zone to match the number of detectors connected in Step 3.

(5) Set the Relay Number switch to the desired shutdown relay.

(6) Select a zone number that is unique in the system and set the value on the Zone Number switches.

(7) The new zone should go into Trouble and display the "Zone Config Change" message in the Monitor Trouble log.

(8) Change the Number of Zones switch on the Monitor node to include the added zone.

(9) The System should go into Trouble and display the "#Zones Switch Change" message in the Monitor Trouble log.

(10) Now press the Self Test button on the Monitor node board.

(11) The Monitor screen will display the "Checking System Configuration" screen while it is verifying the new configuration.

(12) The system will then perform a self test of each zone in the system to verify the number of detectors.

(13) The Monitor screen will display the results of the test.

(14) If the self test passed, the system should not be in Trouble and the passed Self Test screen will appear, as indicated in FIG. 8A. The system is ready for operation or this process can be repeated to add other zones to the system.

(15) if the self test failed, the system and the zone will be in Trouble. As previously described, the Self Test Info log will contain information about the failed zones (See FIG. 8B). This log will not contain failed detector ID numbers until a successful self test has been completed. However, the System Config log will contain a list of the detector IDs that successfully completed the self test. This list of detector IDs can be compared to the list of installed detectors to find the missing detectors. The failure information will also be in the Touble log until the zone successfully passes a Self Test.

(16) After any problem has been discovered and corrected, press the Self Test pushbutton to recheck the system. Continue this process until all errors have been corrected and the zone passes the Self Test.

C. System Messages

The following is a list all of the messages that can appear in the Alarm, Trouble, and system logs.

Alarm Events

These events appear in the Alarm log and the System log.

| EVENT TEXT | DESCRIPTION |
|---|---|
| Fire Detected DXXX | Fire detected by detector XXX |
| Zone Fire Detected | Fire detected in a zone |

Trouble Events

These events appear in the Trouble log and the System log.

| EVENT TEXT | DESCRIPTION |
|---|---|
| Ext Disconnected | Extinguisher output has a supervision fault, caused by an empty extinguisher, a wiring fault, or an extinguisher disabled by the toggle switch |
| Self Test Fail DXXX | Detector XXX failed the zone self test |
| Detector Supv Fault | Detector input has a supervision fault, caused by a wiring fault in the detector string, a missing end of line module |
| Trouble Supv Fault | Monitor node trouble output supervision fault |
| Alarm Supv Fault | Monitor node alarm output supervision fault |
| Power Supply Failure | Monitor not receiving 24 VDC from the power supply |
| Self Test Failure | Zone had failure(s) during self test |
| External PS Fault | Fault detected on PS_TBL input |
| Ground Fault | Ground fault condition detected |
| Battery Low | Battery voltage is low |
| Zone Config Change | A configuration switch has been changed for the zone |
| Battery Supv Fault | Supervision fault in the battery or battery charging transformer connection |
| Zone Comm Error | Communications error detected with the zone |
| Too Many Zones | More zones discovered than specified by the Monitor's number of zones switch setting |
| Not Enough Zones | Fewer zones discovered than specified by the Monitor's number of zones switch setting |
| Too Many Zone Nodes | More that 50 zone nodes discovered during config check |
| Node Not Responding | NOT USED |
| Too Many Detectors | More detectors reported during self test than specified by Zone's number of detectors switch |
| More Than 16 Det | More that 16 detectors reported during self test |
| Not Enough Detectors | Fewer detectors reported during self test than specified by Zone's number of detectors switch; should only occur at install time when detector IDs have not been determined |
| Invalid # Det Setting | Zone's number of detectors has an invalid setting |
| Zone Disabled | An operating zone is set to address 0 |
| # Zones Switch Change | Monitor's number of zones switch has been changed |
| Det Annun Line Fault | Annunciator line fault on a detector string |
| Duplicate Zone Nums | Duplicate zone numbers detected during configuration check |

Log Only Events

These events only appear in the System log.

| EVENT TEXT | DESCRIPTION |
|---|---|
| Ext Connected | Extinguisher supervision fault cleared |
| Self Test OK | NOT USED |
| Detector Supv OK | Detector supervision fault cleared |
| Trouble Supv OK | Trouble output supervision fault cleared |
| Alarm Supv OK | Alarm output supervision fault cleared |
| Power Supply OK | Monitor 24 VDC power restored |
| Self Test Success | Zone has a successful self test |
| External PS OK | Fault cleared on PS_TBL |
| Ground Fault OK | Ground fault condition cleared |
| Battery Low OK | Battery voltage has return to proper level |

-continued

| EVENT TEXT | DESCRIPTION |
|---|---|
| Zone Alarm Reset | Zone reset switch activated on the zone node |
| System Alarm Reset | System alarm reset switch activated on the monitor node |
| Start of Self Test | Self test start |
| Battery Supv OK | Supervision fault cleared in batter circuit |
| Zone Comm OK | Communications restored with the zone |
| Ext Discharged | NOT USED |
| System Log Init | System log initialized |
| End of Self Test | Self test end |
| Detector ID Change | NOT USED |
| Zone Location Change | Zone's zone node address has changed? |
| # Det Switch Change | Zone's number of detectors switch has been changed |
| Relay # Switch Change | Zone's relay number switch has been changed |
| Zone Removed | Zone was not present during last config check |
| New Zone Added | New zone was discovered during last config check |
| Zone Node Removed | Zone node was not present during last config check |
| Zone Node Added | New zone node was discovered during last config check |
| Self Test Aborted X | Self test has been aborted<br>X = 0 - On battery power, auto test cancelled<br>X = 1 - Zone self test disabled<br>X = 2 - Zone is in alarm |
| Config Check OK | System configuration check performed |

A fire protection system with an automatic self-test circuit is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A fire protection system for determining the existence of hazardous conditions within a building, said system comprising:

(a) a central monitor node for monitoring and displaying system status information;

(b) at least one zone node remote from said monitor node, and defining a plurality of fire protection zones within the building;

(c) a plurality of detectors arranged within each zone at respective predetermined address locations, each of said detectors comprising means for detecting and storing information indicating an occurrence of a hazardous event, and having a normal negative state wherein no occurrence of a hazardous event is detected, and a positive state wherein the occurrence of a hazardous event is detected;

(d) said zone node comprising detector interrogation means for interrogating said plurality of detectors to determine their respective positive or negative states, and for determining the address location for each of said plurality of detectors in a positive state indicating the occurrence of a hazardous event, and wherein said detector interrogation means comprises a single shared annunciator line electronically interconnecting said zone node and said plurality of detectors for transmitting a state-querying signal from said zone node to said plurality of detectors, and for those detectors indicating a positive state, said annunciator line transmitting the address location of those detectors in the positive state back to said zone node; and (e) a communication line electronically interconnecting said zone node and said monitor node for relaying information from said zone node to said monitor node indicating the address location for each of said plurality of detectors in a positive state, whereby the address location of all detectors in a positive state is displayed to a system used at said monitor node.

* * * * *